United States Patent [19]

Adams

[11] 4,297,958

[45] Nov. 3, 1981

[54] HOOK DRIVE TRAIN FOR A SEWING MACHINE

[75] Inventor: Kenneth D. Adams, Madison, N.J.

[73] Assignee: The Singer Company, Stamford, Conn.

[21] Appl. No.: 89,800

[22] Filed: Oct. 31, 1979

[51] Int. Cl.[3] ..... D05B 57/36

[52] U.S. Cl. ..... 112/220; 74/398; 74/410; 112/184

[58] Field of Search ..... 74/392, 398, 399, 406, 74/410; 112/181, 184, 191, 220

[56] References Cited

U.S. PATENT DOCUMENTS

| | | | |
|---|---|---|---|
| 358,930 | 3/1887 | Hoyt | 74/392 |
| 1,407,508 | 2/1922 | Apple | 112/220 |
| 2,530,425 | 11/1950 | Eberhardt | 74/392 |
| 2,863,410 | 12/1958 | Lange et al. | 112/220 |
| 3,048,134 | 8/1962 | Fitzgerald et al. | 112/181 X |
| 3,454,145 | 7/1969 | Gegauf | 112/220 X |
| 3,949,690 | 4/1976 | Weisz | 112/184 |

FOREIGN PATENT DOCUMENTS

| | | | |
|---|---|---|---|
| 174273 | 3/1953 | Austria | 112/184 |
| 100036 | 9/1972 | German Democratic Rep. . | |
| 581203 | 8/1962 | Japan . | |
| 1283557 | 7/1972 | United Kingdom | 112/220 |

*Primary Examiner*—Wm. Carter Reynolds

*Attorney, Agent, or Firm*—William V. Ebs; Robert E. Smith; Edward L. Bell

[57] ABSTRACT

An input gear and a hook driving gear in mesh with the input gear in the gear train for the hook of a sewing machine are rendered self-adjusting by having the input gear drive the hook driving gear through a key which is movable in one direction on an input shaft and with respect to which the input gear is movable in a direction perpendicular to said one direction, and by having the hook driving gear drive the hook through shaft affixed collar permitting movement of the hook driving gear transversely relative to a bushing upon which such gear is rotatably mounted.

8 Claims, 6 Drawing Figures

Fig.1
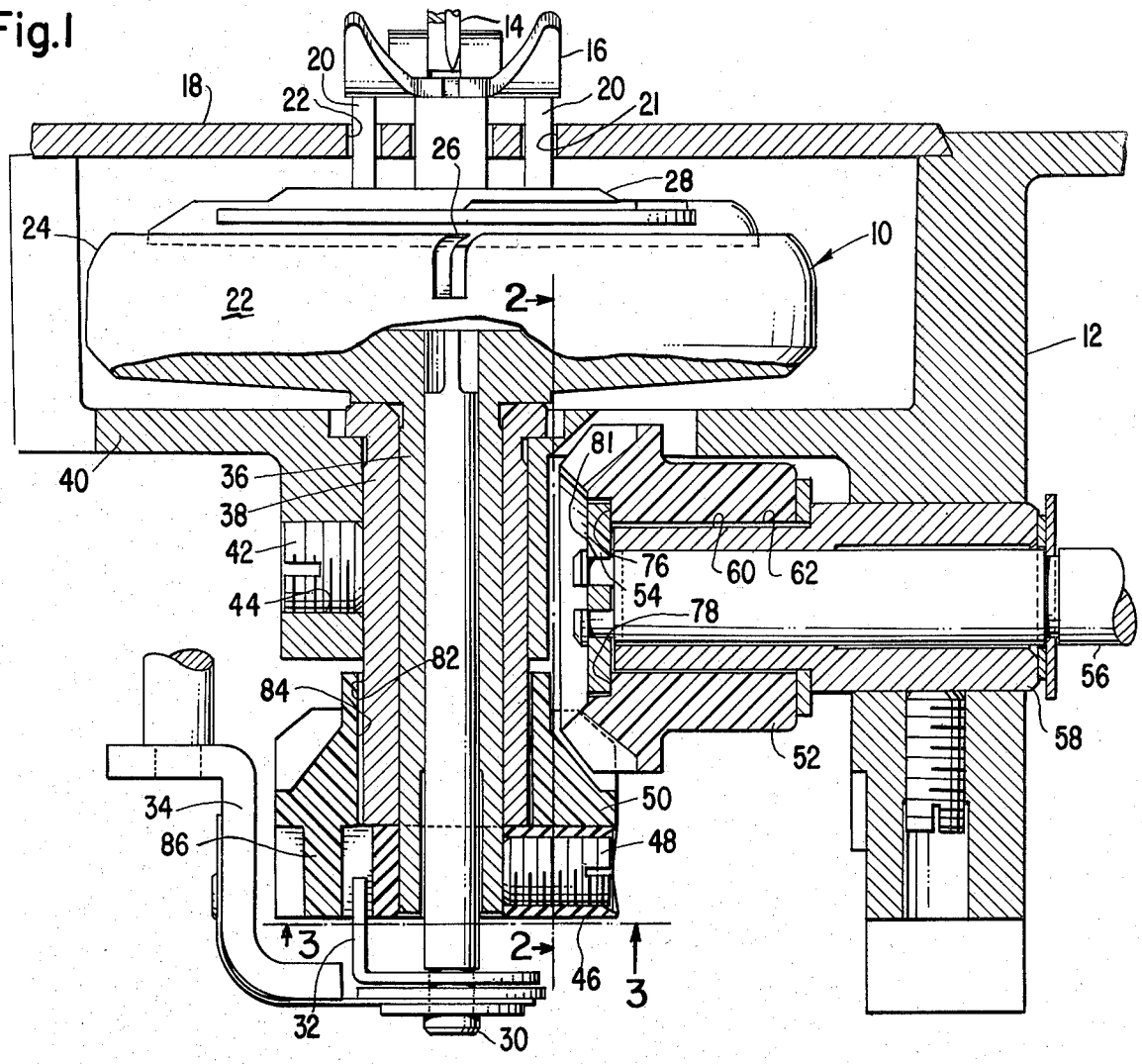
Fig.2
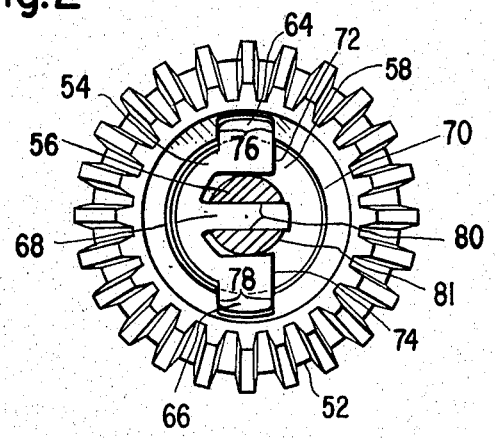
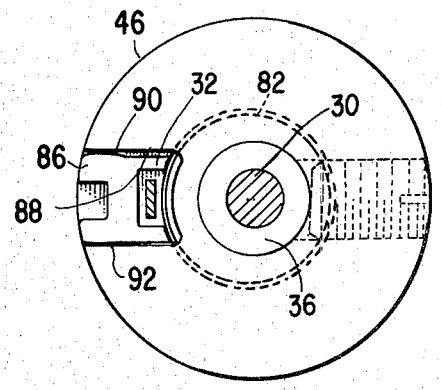
Fig.3

HOOK DRIVE TRAIN FOR A SEWING MACHINE

DESCRIPTION

BACKGROUND OF THE INVENTION

1. Field of the Invention

The invention relates to hook driving mechanism for sewing machines having a vertical axis hook.

2. Description of the Prior Art

In sewing machines having a vertical axis hook, it is common practice to drive the hook through a pair of meshing bevel gears, the input gear of which is rotated about a horizontal axis by an input bed shaft and the other gear of which is driven by the input gear about a vertical axis. Heretofor the input gear has been affixed to the bed shaft, as for example, by a set screw, and because of dimensional tolerances associated with the outer diameter of the shaft and inside diameter of the input gear, such gear was forced into an eccentric position relative to the shaft axis. As a consequence, the meshing gears did not properly engage through 360° of rotation and excessive noise resulted. In constructions wherein the vertical axis gear, hereinafter referred to as the hook driving gear, was secured to a hook shaft by a set screw and thereby caused to assume an eccentric position relative to axis of such hook shaft, the problem was further aggrevated.

It is a prime object of this invention to provide a sewing machine with an improved hook drive train wherein meshing gears operate smoothly without accompanying noise.

SUMMARY OF THE INVENTION

In accordance with the invention, a horizontal axis input gear and a vertical axis hook driving gear in mesh with the input gear in a gear train for the hook of a sewing machine are rendered self-adjusting. A self-adusting capability is imparted to the input gear by having such gear connected to an input drive shaft through a key which is movable on the input shaft in one direction and on which the input gear is movable perpendicularly to the said one direction. The hook driving gear is rendered self-adjusting by having such gear rotate a drive shaft for the hook through a shaft affixed collar that is connected to the hook driving gear through a cam and slot connection permitting movement of the hook driving gear transversely relative to a bushing upon which the gear is rotatably mounted.

DESCRIPTION OF THE DRAWINGS

FIG. 1 is a vertical cross-sectional view taken parallel to a sewing machine bed and showing a hook drive train according to the invention;

FIG. 2 is an end view of a portion of the hook drive train taken on the plane of the line 2—2 of FIG. 1;

FIG. 3 is an end view of another portion of the hook drive train taken on the plane of the line 3—3 of FIG. 1;

DESCRIPTION OF THE INVENTION

Figure 4:
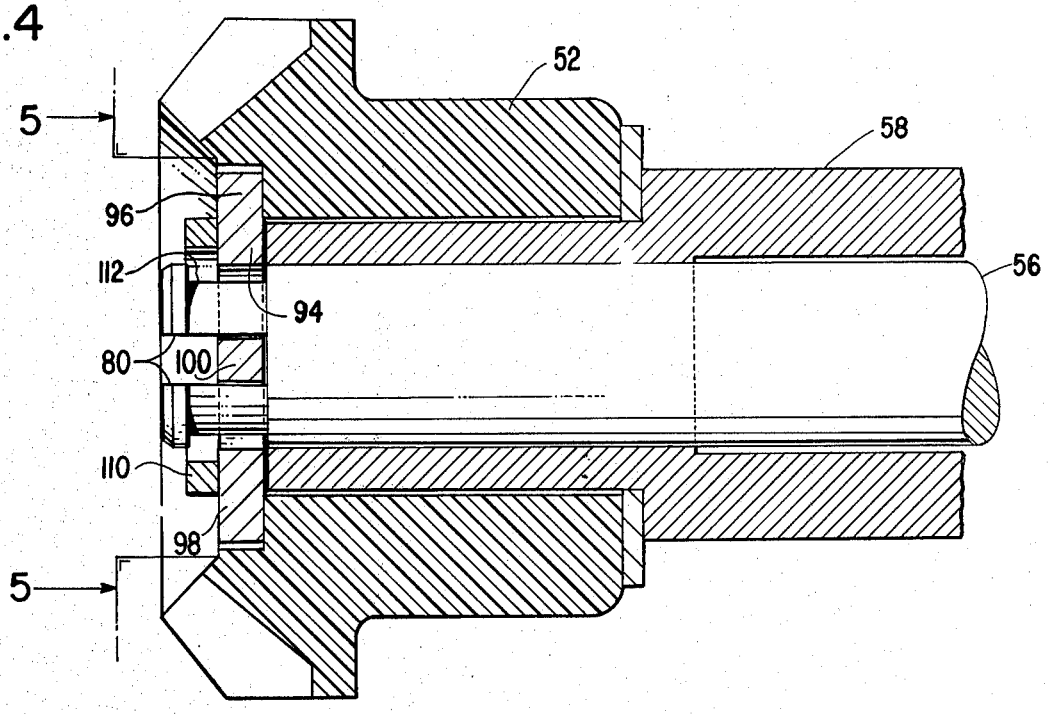
FIG. 4 is an enlarged vertical cross-sectional view illustrating a modified construction for a portion of the hook drive train.

Referring to FIG. 1 of the drawings, reference character 10 generally indicates the hook of a sewing machine. The hook is supported in the bed 12 of the machine. A fragment of a thread carrying needle 14 and a presser foot 16 which are conventional parts of a sewing machine are also illustrated in FIG. 1. A removable needle plate 18 is provided to support work on the presser foot, and a feed dog 20 movable in slots 21 in the plate is provided to feed work during the formation of stitches. A suitable aperture (not shown) in the needle plate 18 permits penetration of the needle 14 through the work and to a position for cooperation with the hook 10. Although not shown in the drawings, suitable actuating mechanism, such as shown for example in U.S. Pat. No. 3,115,855 of The Singer Company, would be provided for imparting endwise reciprocation to the needle 14. The hook 10 is rotated in timed relation to the needle 14 through the driven train of the invention which is described in detail hereinafter. Such drive train is driven from a motor also serving to drive the needle 14 and the feed dog 20.

The hook 10 includes a cup-shaped body 22 with a rim 24 on which there is formed a beak 26 for seizing a loop of thread from needle 14 during reciprocation of the needle and timed rotation of the hook. Disposed within the cavity formed by the cup-shaped body 22 of the hook is a bobbin 28 for storing a supply of thread which during the formation of stitches is concatenated with the needle thread in a well known manner. A spindle 30 with an up-turned finger 32 and laterally extending arm 34 cooperate with the bobbin to form a bobbin winder mechanism or replenishing mechanism of the type disclosed in U.S. Pat. No. 3,693,566 of The Singer Company. The bobbin winding mechanism itself forms no part of the present invention and reference may be made to the said U.S. Pat. No. 3,693,566 for a more complete description thereof.

The drive train for the hook 10 includes a shaft 36 which depends from the cup-shaped body 22 of the hook and is rotatably supported in an eccentric bushing 38 as in the hook drive of Singer's U.S. Pat. No. 3,949,690. The bushing 38 is supported in a web 40 of the bed of the sewing machine and is restrained from rotation by a set screw 42 disposed in a threaded bore 44 in the web 40. The set screw 42 may be temporarily loosened to permit the bushing to be rotated on its axis whereby the hook beak 26 may be adjusted relative to the needle 14 without affecting the timing of the hook driving mechanism.

The drive train for the hook further includes a collar 46 which is affixed to shaft 36 by a set screw 48, a vertical axis hook drive bevel gear 50 which is connected to the collar 46 as described hereinafter, a horizontal axis bevel gear 52 which engages the gear 50, a driving key 54, and a horizontal axis input shaft 56 which is rotatably mounted in a fixed bushing 58 and is driven by the motor for the needle and work feeding mechanism.

In accordance with the invention bevel gear 52 and the driving key 54 are mounted for radial movement in mutually perpendicular directions relative to the axis of input shaft 56 to allow the gear 52 to self adjust within a clearance between the outer surface 60 of bushing 58 and inner surface 62 of gear 52. Referring to FIG. 2 the key 54 may be seen as an open ring with diametrically opposite outwardly extending ears 64 and 66, and a torque transmitting member 68 which extends diametrically across the ring at right angles to the ear extensions to terminate at a free end 70 midway between ends 72 and 74 of the ring. Ears 64 and 66 are received at the end of gear 52 in diametrically opposite slots 76 and 78 of sufficient depth to allow for diametrical movement of the gear on the ears, and member 68 is received at the end of input shaft 56 in a diametrically extending slot 80 wherein the member may slide to accommodate movement of the key and gear in a direction perpendicular to the ear extensions. The key 54 is assembled on shaft 56 by spreading ends 72 and 74 and snapping the ring into a groove 81 formed in the shaft, the key being sufficiently resilient for the purpose.

Bevel gear 50 is mounted so that it may self-adjust within a clearance between the outer surface 82 of bushing 38 and inner surface 84 of the gear. As shown, the gear 50 includes a driving cam member 86 which extends into a radial slot 88 in collar 46 and engages sides of the slot with cam surfaces 90 and 92. Member 86 slides in slot 88 and therefor allows for movement of the gear 50 in the radially extending direction of the slot. Member 86 can also rock in the slot by reason of the engagement of cam surfaces 90 and 92 with the sides of the slot and the gear can therefor move transversely relative to the axis of the collar in directions other than the radially extending direction of slot 88.

When shaft 56 is rotated, torque is transmitted through the key 54 to gear 52 by way of member 68 and the ears 64 and 66; and gear 52 is rotated on bushing 58. Gear 52 drives gear 50, and the gear 50 acting through cam member 86 rotates collar 46 which in turn rotates hook drive shaft 36 and the hook 10. Each of bevel gears 52 and 50 tends during rotation to assume a position with a substantially constant clearance therearound between the inner surface of the gear and the part upon which it is supported, but self adjust transversely with respect to the axis of the part upon which it is rotatably mounted to compensate for any eccentricity in the motion of the other gear. As a consequence, the gears operate smoothly and gear noise is minimized.

Figure 5:
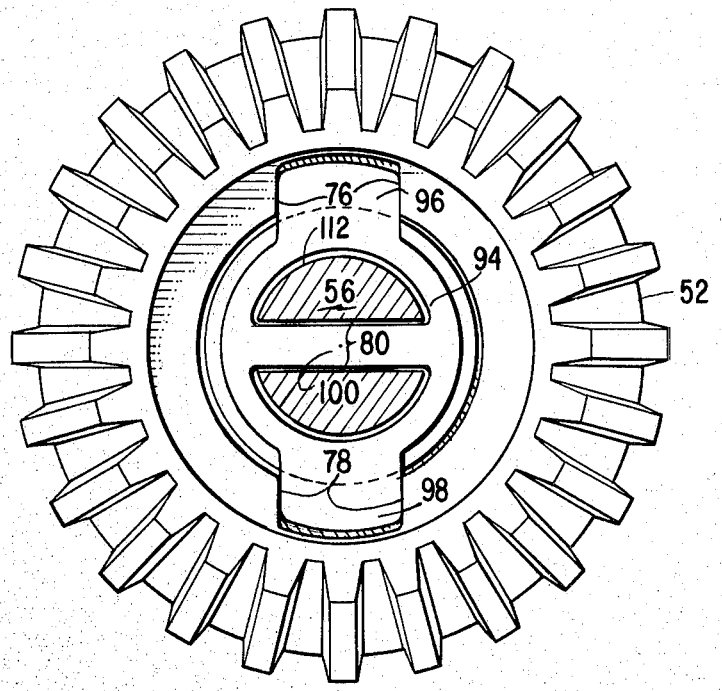
FIG. 5 is an end view of the drive train taken on the plane of the line 5—5 of FIG. 4.
Figure 6:
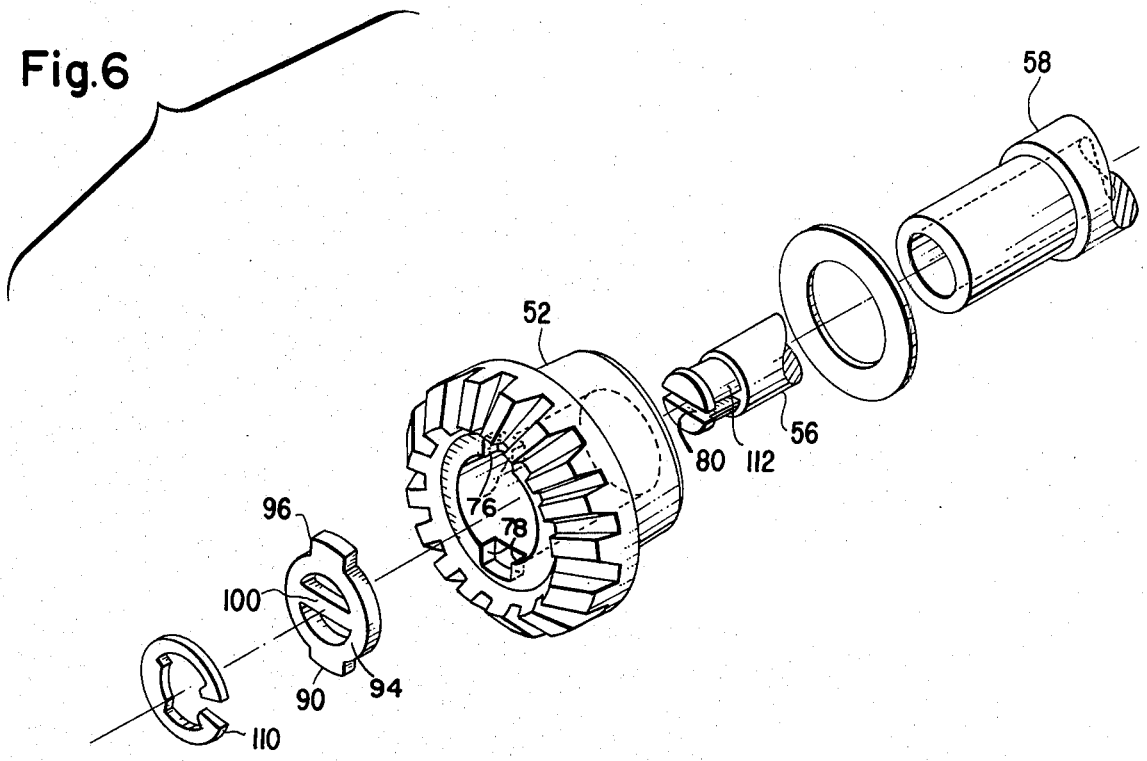
FIG. 6 is an exploded perspective view of the modified portion of the drive train.

Referring to FIGS. 4, 5 and 6 there may be seen an alternate form of driving key 94 for use between the input shaft 56 and bevel gear 52. Such key is constructed as a closed ring with diametrically opposite outwardly extending ears 96 and 98 which enter slots 76 and 78 respectively in gear 52; and with a torque transmitting member 100 which integrally connects with opposite sides of the ring, extends diametrically across the ring at right angles with respect to the ear extensions, and slidably engages the input shaft 56 in slot 80. Because of the closed construction of key 94 with its diametrically extending member connected to opposite sides thereof the key has a large torque transmitting capability. Such key is maintained in a define axial position in the input shaft 56 with a resilient retaining ring 110 which snaps into a groove 112 in the shaft.

Bevel gear 52 has been described as being rotatable supported on a fixed bushing 58 wherein the input shaft 56 is rotatable. It is possible, however to terminate the bushing short of the gear and to rotatably support the gear directly on the input shaft with respect to which the gear could self adjust in mutually perpendicular directions. Various other changes and modifications which may be made in the hook drive train as described herein without departing from the spirit and scope of invention will occur to those skilled in the art, and I aim to cover all such changes and modifications in the appended claims.

I claim:

1. In a drive train for the hook of a sewing machine; and input shaft including a slot which extends diametrically across an end surface of the shaft; an input gear with diametrically opposite slots; a drive key between the input shaft and input gear including a torque transmitting member which is slidable in the shaft slot and permits self adjusting movements of the gear in the direction of such slot, said drive key also including projecting ears which extend in a direction substantially perpendicular to the torque transmitting member and register in the gear slots to provide for self adjusting movements of the gear in a direction perpendicular to the shaft slot; a bushing; a hook drive gear in mesh with the input gear and rotatable on the bushing by said input gear; a drive collar rotatable by the hook drive gear, the collar being connected to the hook drive gear to permit self adjusting movement of the hook drive gear transversely on the bushing; a hook drive shaft rotatable by the collar; and a hook rotatable by the hook drive shaft.

2. The combination of claim 1 wherein the key is an open resilient ring which snaps into a fixed axial position on the input shaft, and on which the torque transmitting member has a free end.

3. The combination of claim 1 wherein the key is a closed ring on which the torque transmitting member connects with opposite sides thereof, and said combination includes a retaining ring on said shaft to resist axial displacement of the key.

4. The combination of claim 3 wherein the key including the torque transmitting member is an integral unitary structure.

5. The combination of claim 1 wherein the connection between the hook drive gear and collar includes a guideway in one such part and a cam on the other in engagement with sides of the guideway.

6. The combination of claim 5 wherein the guideway is in the collar and the cam is on the hook drive gear.

7. The combination of claim 5 wherein the axis of the bushing on which the hook drive rotates is eccentric to the rotational axis of the collar.

8. The combination of claim 7 wherein the collar is affixed to the hook drive shaft.

* * * * *